US005854435A

United States Patent [19]

Kim

[11] Patent Number: 5,854,435

[45] Date of Patent: Dec. 29, 1998

[54] NATURAL RESONANT SPEAKER

[76] Inventor: Young-ahn Kim, 101-703 Tungji Apt., 912 Tunsan-dong, Seo-gu, Teajon, Rep. of Korea

[21] Appl. No.: 731,060

[22] Filed: Oct. 9, 1996

[30] Foreign Application Priority Data

Oct. 13, 1995 [KR] Rep. of Korea ..... 1995 35723

[51] Int. Cl.[6] ..... G10D 3/00

[52] U.S. Cl. ..... 84/291; 84/294

[58] Field of Search ..... 84/291, 294, 295, 84/296, 267, 268, 270, 274, 275, 276, 277

[56] References Cited

U.S. PATENT DOCUMENTS

| | | | |
|---|---|---|---|
| 1,707,115 | 3/1929 | Dierdorf | 84/723 |
| 3,432,001 | 3/1969 | Anastin | 381/118 |
| 3,821,475 | 6/1974 | McKechnie | 381/118 |
| 4,104,945 | 8/1978 | Bolin | 84/294 |
| 4,176,730 | 12/1979 | Mushkin | 181/148 |
| 5,056,400 | 10/1991 | Wachi et al. | 84/600 |

*Primary Examiner*—William M. Shoop, Jr.
*Assistant Examiner*—Shih-yung Hsieh
*Attorney, Agent, or Firm*—Dvorak & Orum

[57] ABSTRACT

There is provided a natural resonant speaker adopting the resonant mechanism of a stringed instrument such as the violin, viola, cello, double bass, or acoustic guitar. It can be said that the stringed instrument is a natural resonant speaker which shows excellent sound frequency characteristics and stereophonic effect by relying on a natural resonant phenomenon. Therefore, the natural resonant speaker outputs a sound signal transferred from an amplifier of an audio system as a stereo sound by adopting a structure which is the same as or similar to the natural resonant structure of the stringed instrument. The natural resonant speaker has a speaker body employing a general figure eight shaped stringed instrument body structure and having at least one resonant hole in a frontal plate thereof, and a vibratory unit for transforming an electrical sound signal into a mechanical sound vibration between resonant holes of the frontal plate.

4 Claims, 5 Drawing Sheets

NATURAL RESONANT SPEAKER

BACKGROUND OF THE INVENTION

The present invention relates to a natural resonant speaker adopting the resonant mechanism of stringed instruments, and more particularly, to a natural resonant speaker adopting the resonant mechanism of stringed instruments which exhibits excellent sound frequency characteristic and stereophonic effect.

The mechanism of stringed instruments such as the violin, viola, cello, double bass, and acoustic guitar is known to offer excellent sound frequency characteristics and stereophonic effect. As shown in FIGS. 1A and 1B, a stringed instrument is comprised of a body 1, a plate 2 for pressing a string 3 thereagainst, a string support 8 for supporting one end of the string 3, bridges 4 and 6 for transferring vibration of the string 3 to the body 1 and forming joint points during the vibration of the string 3, and a tension controller 9 for supporting the other end of the string 3 and controlling the tension thereof.

The operational principle of the stringed instrument as constituted above will be described with an exemplary case of open string vibration. Referring to FIG. 1B, when the string 3 vibrates between an uppermost displacement VH and a lowermost displacement VL via both joints 7 and 7', the tension of the string 3 varies with its vibratory frequency in the direction indicated by the arrow via the bridge 4, that is, up and down, and thus the vibratory tension of the string 3 is applied to the contact point of the bridge 4 and the frontal surface of the body 1. As a result, the vibratory energy of the string 3 spreads all through the body 1. Here, the unique resonant sounds of the stringed instrument are attributed to the unique mechanism of the stringed instrument, having the body 1 composed of a frontal plate, a rear plate, side plates, and resonant holes 5 formed in the frontal plate, in which the vibration of the string 3 resonates.

In the body 1 of the stringed instrument 1, the middle of both side plates is narrow and curved, the frontal and rear plates are convex, and the two resonant holes 5 are formed in the frontal plate adjacent to the curved side portions. The stringed instrument, to a great extent, owes its excellent sound frequency characteristics and stereophonic effect to such structural characteristics of the body 1.

SUMMARY OF THE INVENTION

The object of the present invention is to provide a natural resonant speaker adopting the resonant mechanism of a stringed instrument which shows excellent sound frequency characteristics and stereophonic effect.

To achieve the above object, there is provided a natural resonant speaker comprising: a speaker body having convex lower and upper side portions, concave middle side portions, convex-surfaced frontal and rear plates, and at least one resonant hole formed in the frontal plate adjacent to the concave side portions, in order to generally form an 8-shaped resonant structure shaped like a figure eight; and a vibratory unit directly attached between resonant holes of the frontal plate of the speaker body, for transforming an electrical sound signal into a mechanical sound vibration.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

A natural resonant speaker adopting the resonant mechanism such as the body of a stringed instrument according to the present invention will be described below with reference to the accompanying drawings.

Figure 1A:
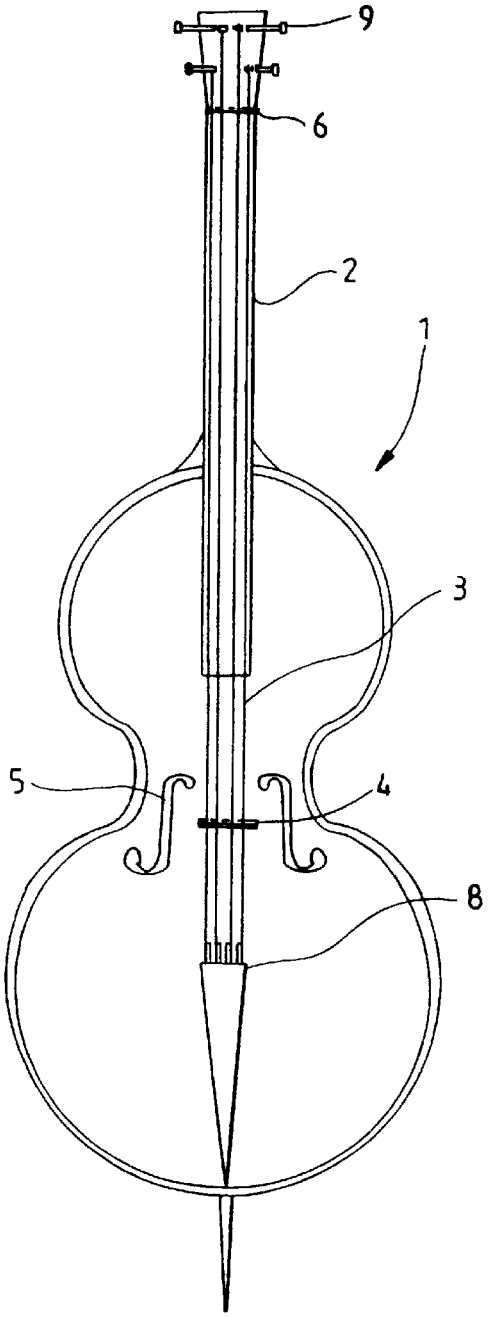
FIG. 1A is a frontal view of a double bass.
Figure 1B:
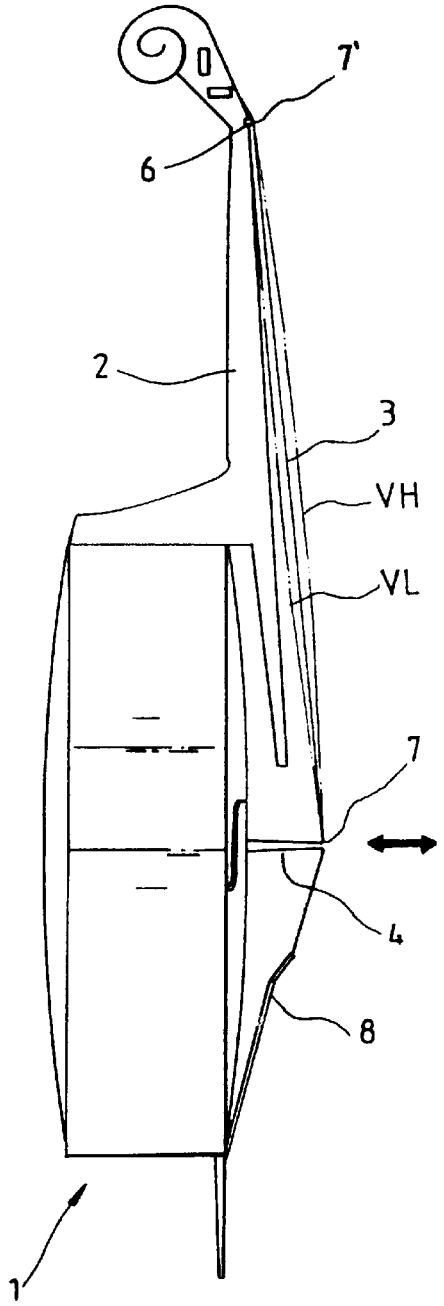
FIG. 1B is a side view of the double bass.
Figure 2:
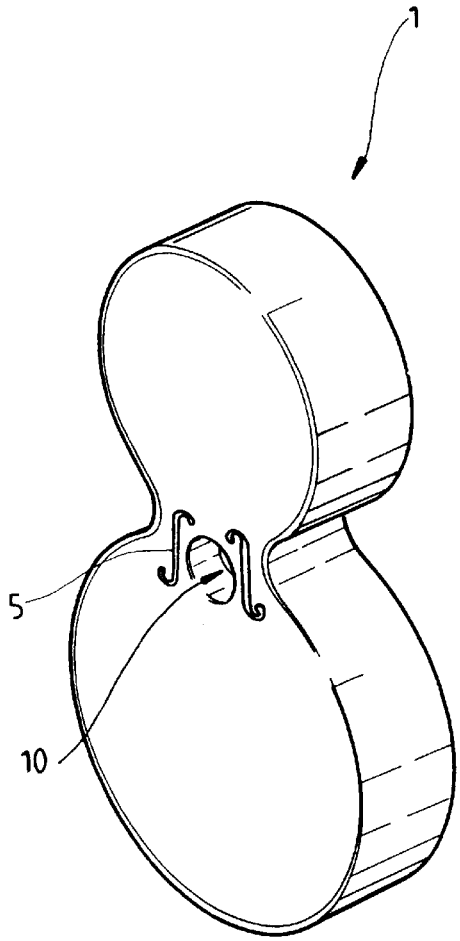
FIG. 2 is a perspective view of a natural resonant speaker according to an embodiment of the present invention.
Figure 3:
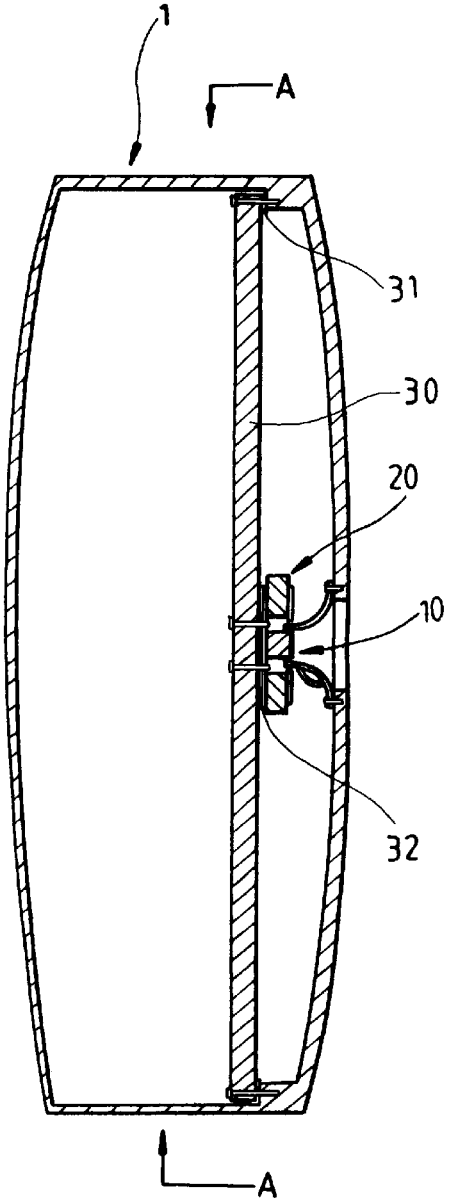
FIG. 3 is a side sectional view of the natural resonant speaker of FIG. 2.

Referring to FIG. 2, the upper and lower side portions of a body 1 of a natural resonant speaker according to the present invention are convex and its midsection is concave. The frontal and rear plates of the body 1 are convex similar to the surface of a sphere and are generally shaped like a figure eight. Two resonant holes 5 are formed directly in the frontal plate near the concave portion of the sides and a vibrator 10 of a vibratory unit for transforming an electrical sound signal into a mechanical sound vibration is formed between the resonant holes 5, or in the upper or lower portions of the frontal plate of the body 1.

Here, the natural resonant speaker uses a resonant structure similar to the body 1 of the stringed instrument as a speaker cabinet and the vibrator 10 is located directly between the resonant holes 5 of the frontal plate of the body 1, and transforms an electrical sound signal transferred from an amplifier of an audio system (not shown) into a mechanical sound vibration.

In the present invention. at least one resonant hole 5 may be shaped like an S, a circle, or any other configuration, and the vibrator 10 may be positioned between the resonant holes 5, or in any place above or below the resonant holes 5.

As described above, the vibratory unit combined with the body 1 includes the vibrator 10 and a magnet structure 20, as shown in FIGS. 3 through 7B.

Furthermore, the vibrator 10 includes a funnel-shaped body 11, a solenoid coil 12 wrapped around the lower part of the body 11, and fixing holes 13 for fixing the body 11 to the frontal plate. A terminal portion 14 for transferring an electrical sound signal supplied from an external audio system (not shown) to the solenoid coil 12 is provided on the outside surface of the body 11.

Here, the funnel-shaped body 11 is formed of wood or synthetic resins. In the former case, the solenoid coil 12 is wrapped around the lower part of the body 11 several times with a strong adhesive, while in the latter case, the solenoid coil 12, already molded, is submerged in the injected material of the synthetic resin body 11. That is, the solenoid coil 12 is combined with the outer lower portion of the funnel-shaped body 11.

Figure 4:
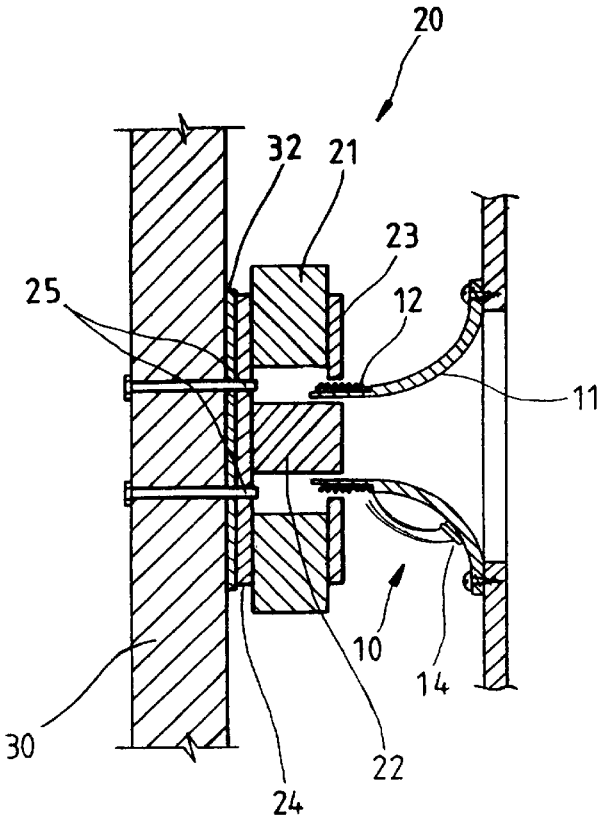
FIG. 4 is a magnified sectional view of an essential portion of the natural resonant speaker shown in FIG. 3.
Figure 5:
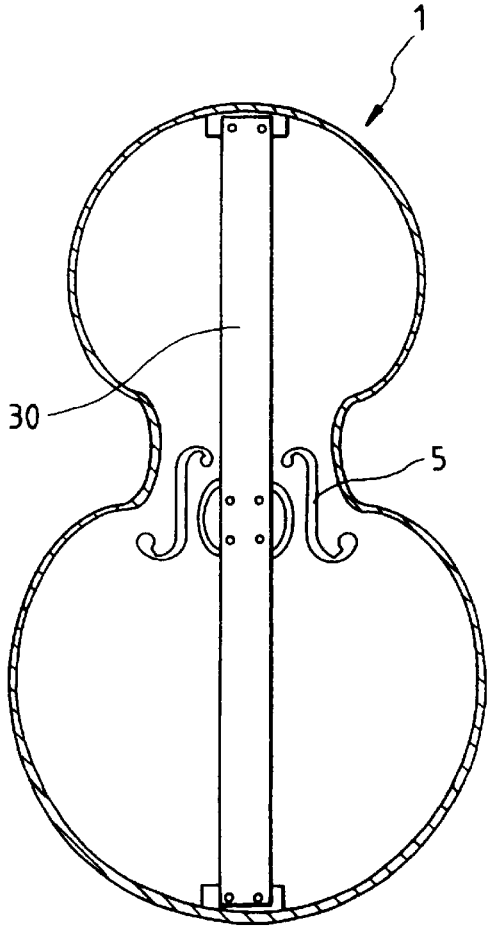
FIG. 5 is a sectional view of FIG. 3 taken along line A—A.
Figure 6:
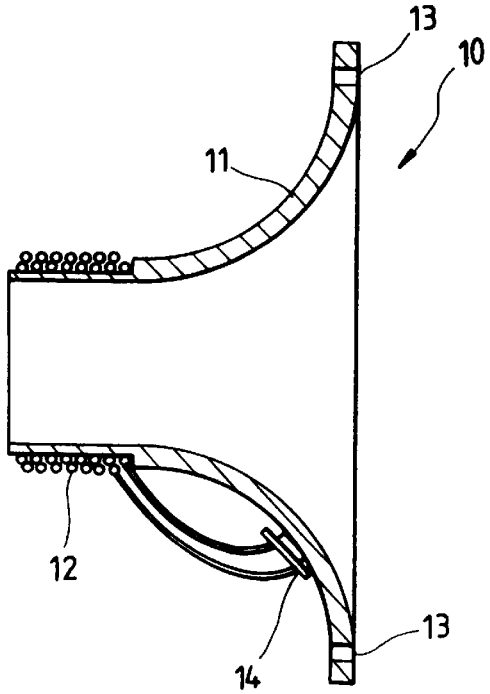
FIG. 6 is a detailed sectional view of a vibratory unit of the speaker shown in FIG. 4.
Figure 7A:
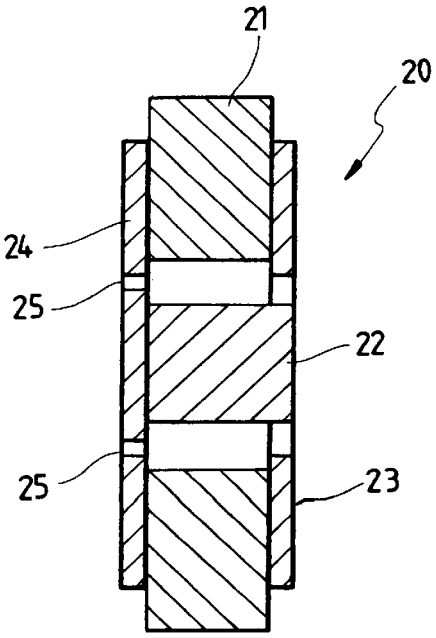
FIG. 7A is a sectional view of a magnet structure of the speaker shown in FIG. 4.
Figure 7B:
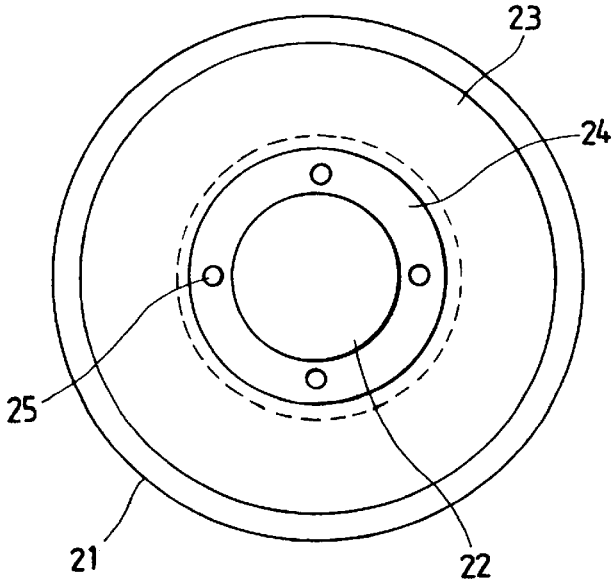
FIG. 7B is a plan view of FIG. 7A.

The magnet structure 20 for generating a magnetic field in the solenoid coil 12 has an annular magnet 21, a magnetic field inductive iron core 22 positioned in the annular magnet 21, and front and rear magnetic field inductive iron plates 23 and 24. This magnet structure 20 and the vibrator 10 are combined to be mechanically detached from each other, as shown in FIG. 4.

The magnet structure 20 is combined with a fixture 30 located in the body 1. The fixture 30 is screw-combined with the body 1 interposing a vibration-proof material 31 such as rubber therebetween, and the magnet structure is also screw-fixed to the fixture 30 interposing a vibration-proof material 32 therebetween. Here, the vibration-proof materials 31 and 32 are used to prevent sound vibrations from being transferred from the body 1 to the fixture 30, and from the fixture 30 to the magnet structure 20.

As described above, the vibrator 10 is inserted into the frontal surface of the body 1 and fixed thereto with a screw or adhesive. The vibrator 10 and the magnet structure 20 are combined to be mechanically detached from each other to improve a low tone reproduction characteristic.

In the natural resonant speaker of the present invention as constituted above, when an electrical sound signal is transferred to the solenoid coil 12 via the terminal portion 14, the solenoid coil 12 vibrates due to the magnetic field of the magnet structure 20, which in turn vibrates the funnel-shaped body 11 of the vibrator 10. As a result, the electrical sound signal is transformed into a sound vibration signal. The sound vibration of the funnel-shaped body 11 is transferred to the body 1, thereby enabling excellent reproduction of sound due to the resonance phenomenon unique to the stringed instrument. Here, excellent high tone characteristics can be obtained and thus sound reproduction characteristics over the audible frequency range can be obtained with just a single vibrator 10 structure, by shaping the body 11 of the vibrator 10 like a funnel. The funnel-shaped body 11 is preferably formed of the same material as that of the body 1. Here, the sound vibration of the vibrator 10 is transferred to the body 1, while the sound vibration is not transferred from either the body 1 to the fixture 30 or the fixture 30 to the magnet structure 20 due to the vibration-proof materials 31 and 32.

Figure 8:
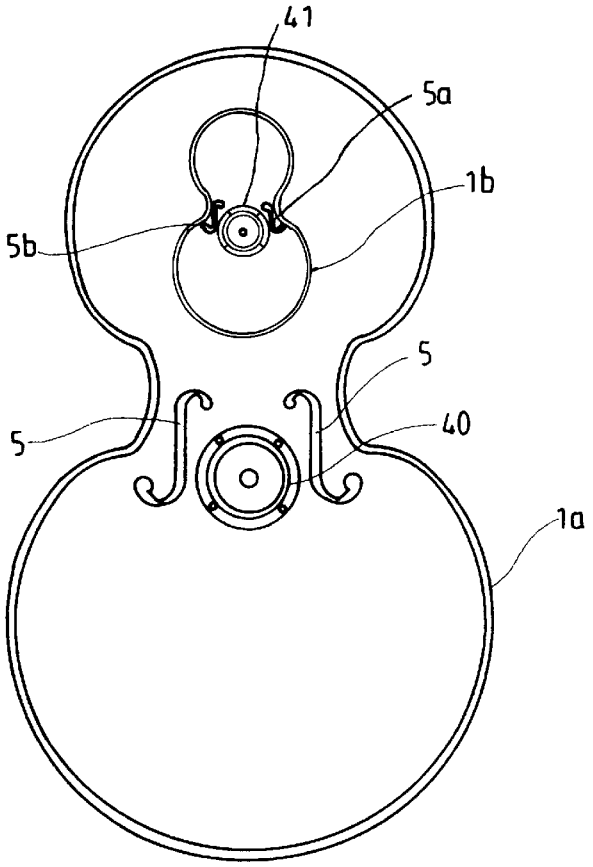
FIG. 8 is a frontal view of a natural resonant speaker according to another embodiment of the present invention.
Figure 9:
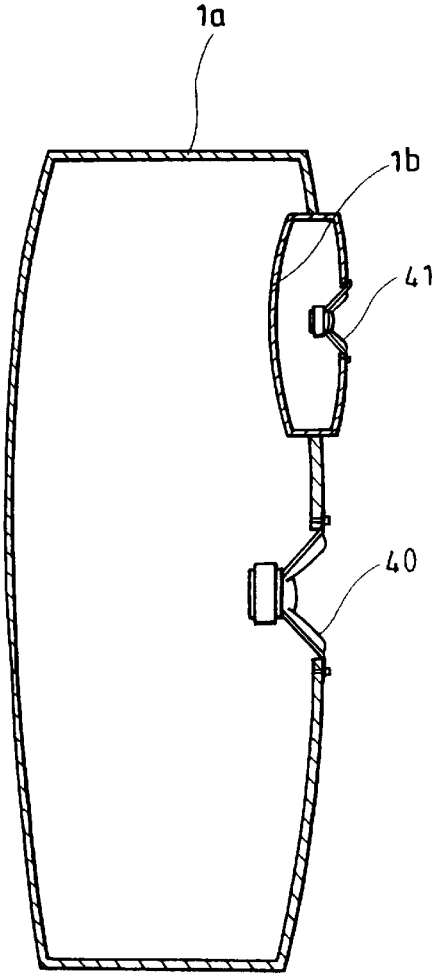
FIG. 9 is a side sectional view of FIG. 8.

FIGS. 8 and 9 illustrate another embodiment of the natural resonant speaker of the present invention. Here, the vibrator is replaced by a conventional speaker unit. Since it is difficult to reproduce all the sounds from a low-tone to a high-tone with the conventional speaker unit, separate speaker units are used for low and high tones, respectively. In the embodiment, a low-tone body 1*a* is combined with a high-tone body 1*b* using a low-tone unit 40 and a high-tone unit 41 together.

The speaker units 40 and 41 may be positioned between their respective resonant holes 5 and 5*a*, or above or below the resonant holes 5 and 5*a* in the frontal plates of the bodies 1*a* and 1*b*. In FIG. 8, the speaker units 40 and 41 are placed between the respective resonant holes 5 and 5*a*. In addition, the high-tone body 1*b* is shown to be positioned in the upper portion of the low tone body 1*a* on the frontal plate. The advantage of such a structure is that a sound radiated toward the rear surface of the speaker units generates excellent resonance inside the body of the stringed instrument and thus produces an excellent stereo sound in both the high and low tonal ranges, and has a higher power output than the vibrator-adopting speaker despite its lower capacity for reproducing an original sound.

As described above, the present invention shows excellent sound frequency characteristics and stereophonic effects by using the body structure of the stringed instrument, separating a magnet structure and a vibrator of a vibratory structure, and directly attaching the vibrator to the body, that is, by adopting the unique resonant mechanism of the stringed instrument.

What is claimed is:

1. A natural resonant speaker comprising:

a speaker body having a hollow inside, said speaker body defined by a pair of opposed convex lower and upper side portions interconnected by concave middle side portions and convex-surfaced frontal and rear plates interconnecting with said upper and lower side portions, said frontal plate having at least one resonant hole formed therein adjacent to said concave side portions, said speaker body generally configured in the form of a figure eight;

a vibratory unit disposed within said hollow speaker body and directly attached to said frontal plate in close proximity to said at least one resonant hole, said unit for transforming an electrical sound signal into a mechanical sound vibration and comprised of a vibrator body having a terminal portion and a magnet structure combined with said vibrator body, said frontal plate including an aperture coincident with said terminal portion of said vibrator body; and a fixture disposed within said hollow speaker body for holding said magnet structure thereto, said fixture is physically detached from said magnet structure by a first vibration-proof material inserted therebetween, said fixture extending between said upper and lower side portions and terminating in close proximity to said side portions, said fixture fixed to said speaker body with a second vibration-proof material therebetween and said first and second vibration-proof materials preventing sound vibrations from being transmitted from said speaker body to said fixture and from said fixture to said magnet structure.

2. The natural resonant speaker as claimed in claim 1, wherein said:

vibrator body is formed into a funnel-shaped configuration having a lower part, wherein a solenoid coil is wrapped around the lower part of said funnel-shaped body and wherein said magnet structure is comprised of an annular magnet for applying a magnet field to said solenoid coil, a magnetic field inductive iron coil positioned within said annular magnet, and front and rear magnetic field inductive iron plates disposed on each side of said annular magnet.

3. The natural resonant speaker as claimed in claim 2, wherein said vibrator body is formed from a same material as that of said speaker body.

4. The natural resonant speaker as claimed in claim 1, wherein said speaker body includes an additional resonant hole spaced apart from said at least one resonant hole, and wherein said vibratory unit is disposed between said at least one resonant hole and said additional resonant hole.

* * * * *